United States Patent [19]

Levsunov

[11] 3,995,447

[45] Dec. 7, 1976

[54] ORNAMENTAL DEFENSIVE RING

[76] Inventor: Ilja Levsunov, 419E 73rd St., New York, N.Y. 10021

[22] Filed: Aug. 14, 1975

[21] Appl. No.: 604,829

[52] U.S. Cl. ..... 63/1 R; 63/15; 63/31; 273/84

[51] Int. Cl.[2] ..... A44C 9/00

[58] Field of Search ..... 63/1 R, 3, 31, 15; 273/84, 67 B

[56] References Cited

UNITED STATES PATENTS

| | | | |
|---|---|---|---|
| 107,016 | 9/1870 | Egge et al. | 63/1 R |
| 309,426 | 12/1884 | Wickersham | 63/1 R |
| 1,597,589 | 8/1926 | Ferrari | 63/1 R UX |
| 2,812,604 | 11/1957 | Nelson | 63/15.3 X |

FOREIGN PATENTS OR APPLICATIONS

| | | | |
|---|---|---|---|
| 626,617 | 5/1927 | France | 63/15 |

*Primary Examiner*—F. Barry Shay
*Attorney, Agent, or Firm*—Otto John Munz

[57] ABSTRACT

An ornamental and defensive finger ring formed of a plurality of ring sections each having a central circular aperture to encircle the finger of a wearer, and held in stacked sequential, contacting relation with respect to a common central axis of the sections, at least one section being selectively adjustable for guided angular movement about the axis, between a first and ornamental position and a second position wherein the sections are releasably held in a different ornamental and defensive relation.

15 Claims, 14 Drawing Figures

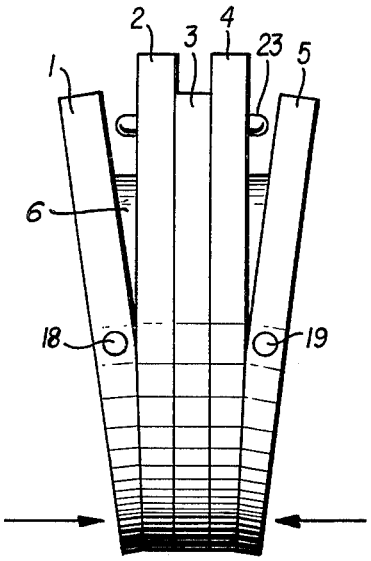
FIG. 5
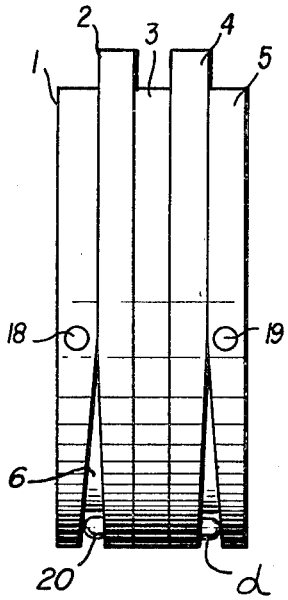
FIG. 6
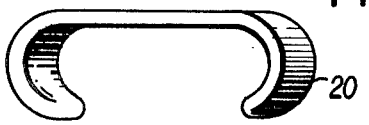
FIG. 8
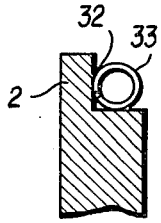
FIG. 9
FIG. 11
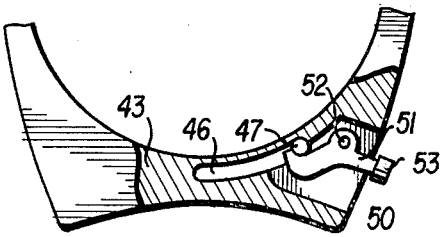
FIG. 12
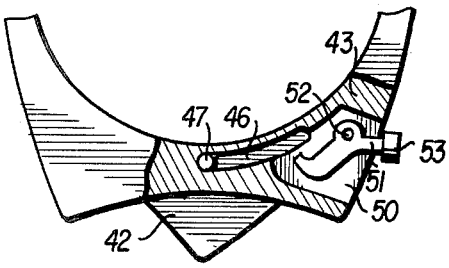
FIG. 13
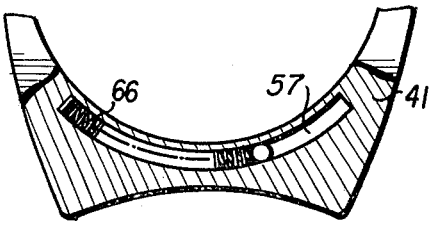

ORNAMENTAL DEFENSIVE RING

SUMMARY OF THE INVENTION

This invention relates to a finger ring formed of a plurality of ring-like sections each apertured to encircle and fit the finger of a wearer, and held in superposed stacked relation with respect to a common central axis. One or more of the rings are releasably held in a selected one of two angular positions with respect to the others, about the axis, whereby the ring may have two different ornamental and attractive appearances and in one position may have enhanced defensive properties.

A further purpose is to provide a ring as aforesaid wherein the adjustment to an enhanced defensive position may be instantaneously effected by a slight bending of the finger on which the ring is being worn.

Another object is to provide a multi-section ring as aforesaid wherein alternate sections are positively but releasably held in either of two angular positions about the common axis, with respect to the remaining sections, are continuously urged to second or enhance defensive position, and held against movement to such position by instantaneously actuable latch means.

An important object is to provide an ornamental ring which may be constructed in a wide variety of attractive appearances and which can be instantaneously altered from one to another appearance and in one position has enhanced defensive properties.

A further object is to provide a ring of the type aforesaid which may be made from a wide selection of metals, is relatively simple and reliable in operation and wear, and capable of quantity production at relatively low cost per unit.

BRIEF DESCRIPTION OF THE DRAWING

FIG. 5 is a side elevation showing how axial force on the two end sections acts to release latch mechanism automatically effecting adjustment of the two groups of ring sections from the position shown at FIGS. 1 and 2, to that of FIGS. 3 and 4;

FIG. 6 is a view like FIG. 5 but showing the appearance after latch-releasing force has been released;

FIG. 8 is a detail perspective view to a still greater scale, of the leaf spring urging the end sections into the position of normal wear; FIG. 9 is a detail section taken in a plane identified by line IX—IX, FIG. 7;

FIG. 11 is a detail sectional view through the middle ring section showing the releasable latch holding one group of sections in a first position of angular adjustment;

FIG. 12 is a view corresponding to FIG. 11 but showing the latch moved to release position before it is returned to the position of FIG. 11;

FIG. 13 is a detail plan view of a portion of the first or end section, showing spring mechanism urging the interconnected second and fourth sections to the rotational position of FIG. 12.

DESCRIPTION OF THE PREFERRED EMBODIMENTS

For clarity of description the term "section" will be used to identify the individual ring components as distinguished from the term "ring" identifying the assembled sections as worn, it being noted that each section is in itself a full circular band.

Figure 3:
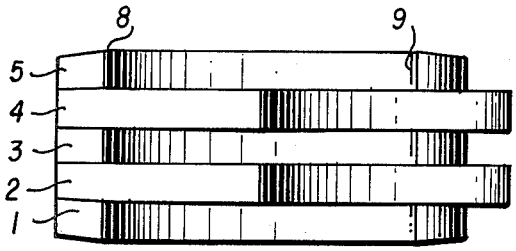
FIG. 3 is a front elevation corresponding to FIG. 1, but showing the ring sections in a second position of relative angular adjustment.
Figure 7:
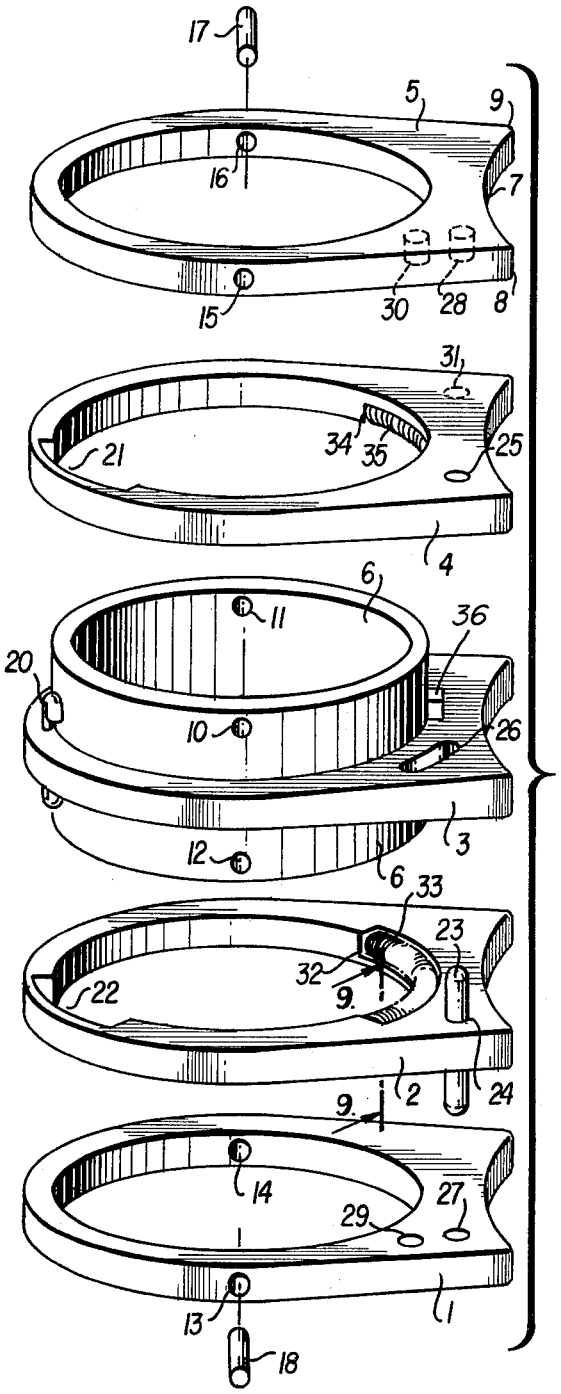
FIG. 7 is an exploded perspective view to a greatly enlarged scale, showing details of construction normally concealed when the ring is assembled and ready for wear.

In FIG. 7 the sections are identified, bottom to top, as 1, 2, 3, 4 and 5. All are generally circular and sized for a smooth fit about a mounting or centralizing cylinder 6. The total or over-all axial dimension of the cylinder is equal closely to the combined thicknesses of the sections so that as indicated upon FIGS. 1 and 3, its ends are normally flush with the outer end surfaces of sections 1 and 5. The cylinder is internally sized for a smooth fit about the finger of a wearer.

The ring sections may all be of the same metal such as platinum, gold, silver, alloys thereof, stainless steel or any other suitable selected materials. Or for improved attractiveness sections 1, 3 and 5 might be of gold, sections 2 and 4 of silver and cylinder 6 of stainless steel. This is but one of a large number of combinations limited only by the imagination and skill of the designer. As shown upon FIG. 7 all sections are radially enlarged at their rightward portions which have an arcuate cut out as indicated at 7, FIG. 7, for section 5, to thus form points or projections 8 and 9 which enhance the defensive feature of the invention. However, numerous changes in the external configuration of the radially enlarged portions are contemplated either to enhance the ring's defensive characteristics and/or to improve its attractiveness. It is pointed out however that apart from defensive considerations the contour shown at FIG. 7 is useful in facilitating angular adjustment of the two groups of sections, from the position of FIG. 3 to that of FIG. 1.

Ring section 3 is rigidly attached to cylinder 6 as by soldering, brazing or riveting, to lie in a plane midway between its ends. Sections 2 and 4 contact respective opposite faces of section 3 and are free for smooth accurate and limited rotation about the central axis of the cylinder, as subsequently explained. End sections 1 and 5 contact the contiguous faces of sections 2 and 4, respectively.

Cylinder 6 has pairs or diametrically-disposed bores 10, 11 formed in one end thereof, FIG. 7. A like pair of bores one of which is identified at 12, are formed in the other end. The axes defined by the two pairs of bores are parallel. Likewise end sections 1 and 5 have diametral bores 13, 14 and 15, 16, respectively. In the assembled ring a pivot pin 17 passes with a smooth fit through bores 11 and 16 while a second pin 19, FIGS. 5 and 6, traverses bores 10 and 15 to thus connect section 5 to the cylinder for very limited angular movement about a diametral axis determined by the pins. Since the other end section 1 is similarly pivotally connected to the cylinder it is sufficient to identify pin 18 positioned in bores 12 and 13. A second pin which is not shown is located in bore 14 and an aligned bore in cylinder 6, diametrically opposite bore 12. As best shown upon FIGS. 5 and 6, end sections 1 and 5 are slightly chamfered or tapered over the lower halves of their interfaces with sections 2 and 4, respectively, thus providing an angle $\alpha$ of between about 2° to 16° for the limited pivoting of the end sections. On FIGS. 5 and 6 the described taper is shown somewhat exaggerated for clarity of illustration. Further in a preferred model all five sections will be slightly tapered on both faces, top to bottom as viewed on FIGS. 5 and 6 so that for added comfort the total thickness of the ring will be less over that portion passing about the inside of the finger during normal wear. Since the difference in thickness is only a few millimeters it is not shown upon the drawing.

Figure 4:
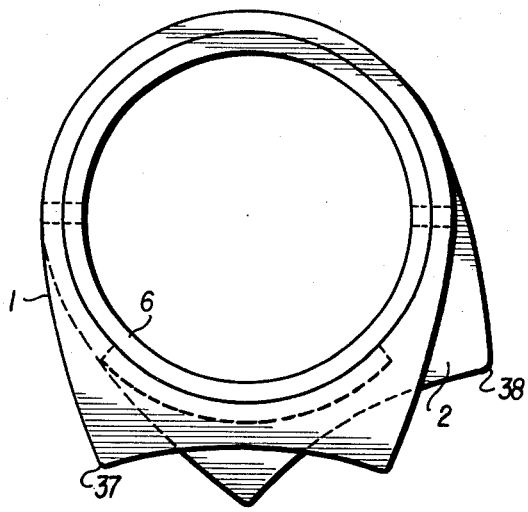
FIG. 4 is a plan view corresponding to the adjustment of FIG. 3.
Figure 14:
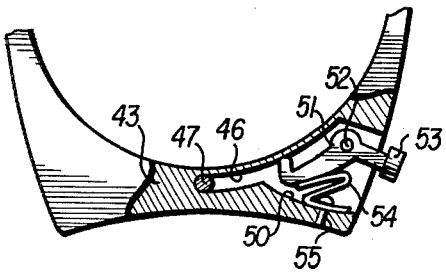
FIG. 14 is a sectional detail showing the release lever and its actuating spring.

Central section 3 has a C-shaped leaf spring 20 (see FIGS. 7 and 8) passing through an aperture in the section. The spring may be mounted to slide axially in and relatively to the aperture or it may be fixed therein so that its curved ends project equally on opposite faces of the section. That portion of the spring extending upwardly, FIG. 7, passes freely through a slot 21 in section 4 and in the assembled ring bears against the inside face of section 5. Likewise the other curved end of the spring traverses freely a slot 22 in section 2 and in the assembled ring bears with its curved end against the inside face of section 1. Thus the spring acts constantly to urge the end sections 1 and 5 into the positions shown at FIG. 6, that is, the position of normal wear. It is also noted that when a wearer bends his finger on which the ring is worn, as in forming a fist, a force is automatically applied axially of the cylinder and which can act to pivot the end sections from the position of FIG. 6 to that of FIG. 5, thus releasing detent or latch mechanism to be described and automatically effecting relative rotation between the two groups of sections from the position shown at FIG. 1, to that illustrated on FIG. 3. Slots 21 and 22 are of angular extent sufficient to permit free limited pivoting of the sections 2 and 4, on and about the central axis of cylinder 6. In fact they may be so dimensions in circumferential extent as to determine and limit those sections in the two positions shown upon FIGS. 2 and 4.

Sections 2 and 4 are interconnected for rotational adjustment as a unit about the central longitudinal axis of the cylinder. For this purpose a rod 23, FIGS. 5 and 7, having rounded ends, fits smoothly in the assembled ring, through a bore 24 in section 2 and another 25 in section 4. The rod passes with a smooth fit through an arcuate slot 26 in section 3. The rod is of a length such that in the assembled relation of FIG. 6 its rounded ends are held by spring 20, seated in recesses 27 and 28 respectively, in the inner surfaces of sections 1 and 5, and thus releasably holds the sections in that relation. Likewise, sections 1 and 5 have second recesses 29 and 30 respectively, so angularly positioned with respect to sections 2 and 4 that when the latter are in the relation of FIG. 4 the ends of rod 23 enter and are releasably held therein by spring 20.

Since rod 23 passes with a smooth and accurate fit through bores in sections 2 and 4 it also acts to unite these sections for rotational adjustment as a unit about the axis of the cylinder. However it is contemplated that additional or supplemental means not shown may be provided for firmly interconnecting sections 2 and 4. Such means for instance would be a second rod disposed symmetrically opposite rod 23, having a length equal to the combined thicknesses of sections 2, 3 and 4 only, and with a press fit of its respective ends in bores in the sections 2 and 4, while passing loosely through an arcuate slot like 26 in section 3. One such bore is identified in dotted lines at 31, section 4, FIG. 7. This auxiliary rod would supplement rod 23 in uniting sections 2 and 4 to cause them to move angularly as a unit.

Means for continuously urging the connected sections 2 and 4 relatively to the other group consisting of sections 1, 3 and 5 are provided. Referring to FIG. 7, ring section 2 has its inner periphery cut away over an arc of limited extent as indicated at 32 to form a seat for a coil spring 33. See also FIG. 9. In a like manner section 4 is cut or milled away at 34 to form a seat for coil spring 35. Section 3 is provided with an abutment 36 firmly fixed thereto. The abutment may be a short rod having a length slightly less than the combined thicknesses of sections 2, 3 and 4 and extending axially equal distances from the two faces of the section. The abutment is located essentially as shown upon FIG. 7 and may have a press fit in an aperture or notch in or closely adjacent the inner periphery of the section.

Springs 33 and 35 are shown upon FIG. 7 as extending throughout the arcuate extent of their respective channels. But in the assembled ring, abutment 36 is disposed with its ends protruding into the respective channels with each spring having one end bearing against the abutment and its other end pressing against one end of its channel so that the two sections 2 and 4 are continuously urged into rotation as indicated by the arrows adjacent those sections, FIG. 7. Since sections 2 and 4 are coupled for conjoint angular movement it is contemplated that one of the springs 33, 35 and its channel, may be omitted with a consequent shortening of abutment 36. However using two springs makes the action smooth, positive and eminently reliable.

Assembly of the ring is simple. With spring 20 and abutment 36 in place, section 3 is passed over cylinder 6 and secured thereto as previously described. Spring 33 is placed in its channel and section 2 is passed over its end of the cylinder so that leaf spring 20 enters slot 22. Just before moving the section axially into final location contacting section 3, spring 33 is compressed until its lower end as viewed in FIG. 7, contacts and presses against abutment 36. The section is then slid into final position. Section 4 is similarly emplaced with the corresponding end of spring 35 pressing against the abutment.

Rod 23 is passed through bore 24, slot 26 and bore 25 and then the end sections are moved into place and pivot pins 17, 18 etc. are passed through the aligned bores in these sections and the cylinder. The ends of the pins are slightly headed or upset to secure them in place. The ends of the cylinder may then be ground and/or polished until flush with the contiguous surfaces of the end rings. The final assembled position is such that, due to urge of spring 20 the ends of rod 23 are seated in one of the recesses 27, 29 of section 1, and 28, 30 of section 5.

Figure 1:
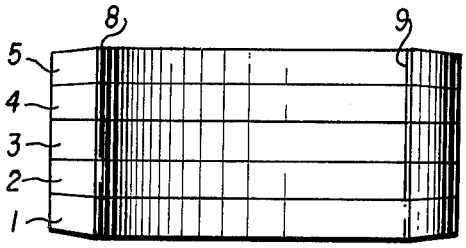
FIG. 1 is a front elevation showing the ring sections in a first selected position of angular adjustment.
Figure 2:
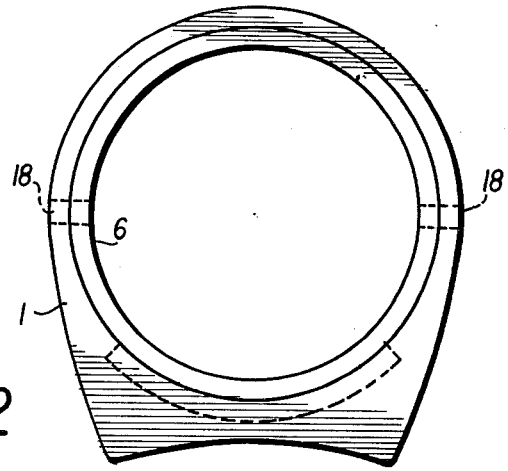
FIG. 2 is a plan view with the sections in the position of FIG. 1.

In use, assuming the sections are as they appear upon FIGS. 1 and 2, the ring is worn in the usual way. When it is desired to change the appearance to that of FIGS. 3 and 4, the wearer merely flexes the fingers of his hand to closed position. This applies a force to the end sections 1 and 5 and causes them to pivot to the positions shown somewhat exaggerated on FIG. 5. This moves the ends of rod 23 out of the recesses in those sections and thus releases sections 2 and 4 to the thrust of springs 33 and 35, which sections instantaneously move angularly to the positions shown upon FIGS. 3 and 4, as determined by spring 20 and slot 22 or other stop means embodied in the ring for that specific purpose. When the hand or fingers are again opened, spring 20 acts to return the sections to the FIG. 6 positions wherein the ends of rod 23 are pressed into recesses 29 and 30. When it is desired to return the ring to the appearance of FIGS. 1 and 2 force is again applied to the end sections to pivot them as in FIG. 5 as indicated by arrows. Then, with the fingers of the other hand engaging two points such as 37 and 38, FIG. 4 the two groups are moved back into the relation of FIGS. 1 and 2 and the axial force is removed to thus maintain them as desired.

By using stones or enamel inserts of various colors for the arcuate cut-outs such as 7, FIG. 7, the ring may be instantaneously and attractively altered in appearance. Merely as one example, the face or surface conjointly formed by the arcuate cut-out portions may appear as a series of vertical differently-colored parallel stripes in the FIG. 1 position, and altered to a "checker-board" appearance when in the FIG. 3 position. Many other interesting effects and appearances will occur to the designer. As will be noted it is possible to effect instantaneous shift to the enhanced defensive position of the sections, shown at FIG. 4.

In the embodiment of FIGS. 10 through 14 the ring sections 41, 42, 43, 44 and 45 have the same general shape as those shown on FIGS. 1 to 9. Section 43 is firmly connected to cylinder 40 midway between its ends. This section has an arcuate slot 46 milled therein closely adjacent its internal periphery. A rod 47, FIGS. 10, 11 and 12, has a length equal to the combined thicknesses of sections 42, 43 and 44, and passes with a smooth fit through the slot. The ends of the rod have a press fit or are otherwise secured within bores 48 and 49 in sections 42 and 44, respectively. The rod thus acts to firmly unite those sections for angular movement as a unit about the central axis of the cylinder.

Section 43 has a radial slot 50 formed, as by milling, in its wall, in communication with slot 46. A latch or lever 51 of shape clearly shown at FIGS. 11 and 12, fits smoothly within slot 50 and is pivoted therein between its ends, by a pivot 52 fixed in bores in the section aligned on an axis parallel with that of cylinder 40. The lever has one end projecting to the exterior of the section and there provided with a knob 53. The other end of the lever, within slot 50 is hook-shaped as shown. In the position of FIG. 11 the hooked end extends into slot 46 and may there engage about rod 47 when the ring sections are in the aligned relation as in that figure, to thereby releasably hold the sections in the relation shown, which relation corresponds to that shown also on FIGS. 1 and 2. A leaf spring 54 in the form of an "S" fits within slot 50. This spring is shown upon FIG. 14 but is omitted from FIGS. 11 and 12 to avoid excessive and possibly confusing details. It has one end pinned within the slot at 55 and bears at its other end against the lever to continuously urge it into the angular position shown upon FIGS. 11 and 14. When knob 53 is manually moved to the position of FIG. 12, its hooked end is out of slot 46 and free and clear of rod 47.

Figure 10:
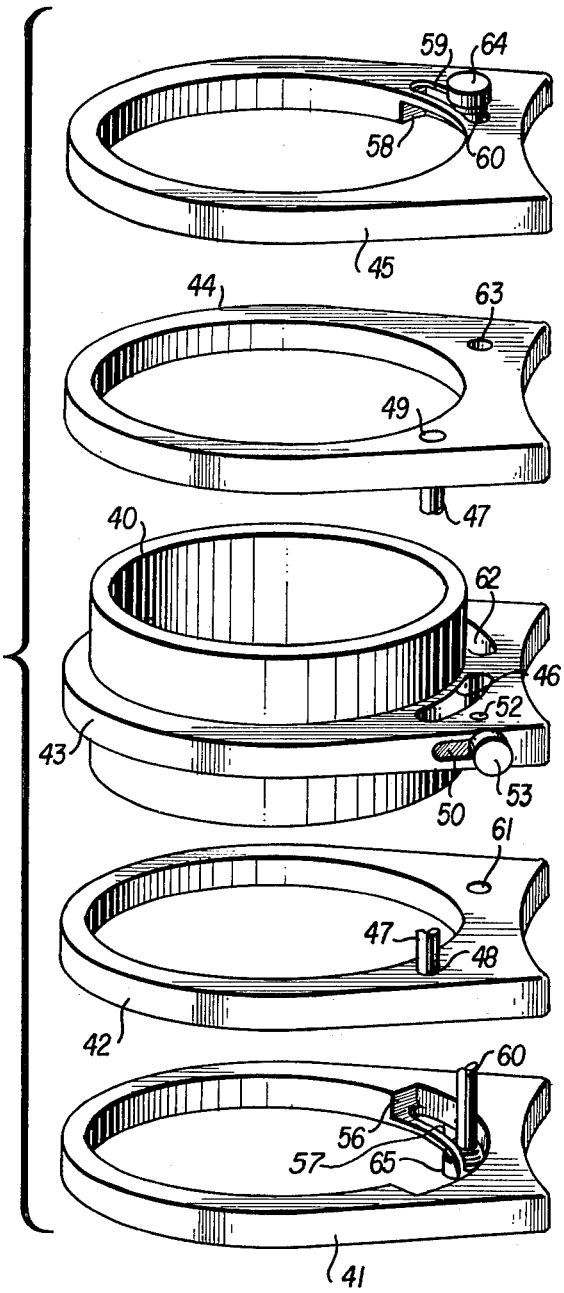
FIG. 10 is an exploded perspective view to a greatly enlarged scale, showing details of a second embodiment, certain parts being omitted for clarity of illustration.

As best shown upon FIG. 10, section 41 has a spring seat channel 56 of limited arcuate extent, opening through the inner face and periphery. An arcuate slot of lesser angular extent than channel 56, opens through one side wall of the channel and the outer face of the section. The other outer section 45 is allochirally formed with a like spring seat channel 58 and arcuate slot 59 as clearly appears from FIG. 10. A shaft 60 has a length somewhat in excess of the total thicknesses of the five sections and passes with a smooth fit in the assembled ring, in succession through slot 57, a bore 61 in section 42, an arcuate slot 62 in section 43 and a bore 63 in section 44, to and through slot 59 in section 45. The shaft has knobs 64, 65 fixed to its respective ends. These may be grasped between the thumb and forefinger of one hand, to angularly move sections 42 and 44. The shaft also acts supplemental to rod 47, to interconnect these sections for adjustment as a unit.

A coil spring 66, not shown upon FIG. 10 but appearing on FIG. 13, is seated in channel 56 and bears at its respective ends against one end of the channel, that is, the end nearest the observer, FIG. 10, and shaft 60. Likewise a second coil spring not shown but which may be a duplicate of item 66, is seated in channel 58 and bears at its ends against the corresponding end of the channel and shaft 60. Thus these springs conjointly act continuously to urge shaft 60 from the position shown at FIG. 10, to one wherein it contacts the other end of slots 57 and 59, to effect a corresponding angular movement of sections 42 and 44 about the axis of cylinder 40. It is contemplated that one of these coil springs such as 66 may be sufficient to effect the desired rotative function, in which case the channel in one end ring may be omitted and the cost of production correspondingly reduced. However, the use of two springs affords very smooth and reliable operation.

The operation is similar to that previously described in connection with the embodiment of FIGS. 1 to 9. Assuming the ring is being worn with its sections in the relation shown upon FIG. 11, when it is desired to adjust to the FIG. 12 position it is merely necessary to move the finger next to the one on which the ring is being worn, over knob 53 and press it to the release position of FIG. 12. This releases rod 47 and enables the two springs such as 66, FIG. 13, acting against shaft 60, to adjust the sections 42 and 44 to the position of FIG. 12. Release of force on the knob enables spring 54 to return the latch lever to the FIG. 11 position. When it is desired to return the sections to the aligned relation of FIG. 11 it is merely necessary to grasp knobs 64, 65, between the thumb and forefinger of the other hand and then angularly move sections 42, 44 to their original position. Lever 51 is formed with a cam-shaped nose so that it is automatically cammed out of slot 46. It is emphasized that in both embodiments adjustment to the positions of FIGS. 4 and 12 may be effected instantaneously, without removal of the ring from the finger. When the sections move into final aligned relation, spring 54 restores lever 51 to the holding position of FIG. 11.

Many changes of shape, disposition and relation of parts, number of sections, substitutions of equivalents, and variations in design and appearance will readily occur to those skilled in the art, after a study of the foregoing specification. Hence the disclosure is to be taken in an illustrative rather than a limiting sense. Like section 43, sections 41 and 45 are fixed to cylinder 40 in any suitable way such, as by soldering, brazing, adhesive, pins or machine screws. In the claims, the expression "small angle" is to be interpreted as one within the range 30° to 60°.

I claim:

1. In a finger ring, at least first and second like ring sections each sized for wear about the finger of a wearer, first means connecting said sections in superposed contiguous relation coaxially of a common central first axis through the section openings, and for relative angular adjustment with respect to each other about said first axis, between first and second limiting positions, resilient means acting between said sections and urging the same into said second position, and latch means connected between said sections and releasably holding the same in said first position, against the urge of said resilient means.

2. The ring of claim 1, each said section being externally shaped to form at least one radially- and outwardly-projecting point, the point of each section being disposed in a common plane containing said first axis when said sections are in said first position, and angularly related about said first axis when said sections are in said second position.

3. The ring of claim 1, each said section being externally shaped to form first and second radially- and outwardly-projecting points angularly spaced through a small angle about said first axis, the first and second points of each section being disposed in respective ones of first and second angularly-related planes containing said first axis when said sections are in said first position, each said point being disposed in a respective one of four planes containing and angularly related about said axis, when said sections are in said second position.

4. The ring of claim 1, there being in addition to said first and second ring sections, third, fourth and fifth ring sections, all said sections connected by said first means in stacked relation in the order mentioned, coaxially of said first axis, said first means also mounting said first section for limited angular pivoting relatively to the remaining sections, about a second axis normal to said first axis, said latch means being released by and in response to limited angular pivoting of said first section, about said second axis.

5. The ring of claim 4, said fifth section also being mounted for limited angular pivoting relatively to said second, third and fourth sections, about a third axis parallel to said second axis, said latch means comprising a rod passing through aligned bores in said second and fourth sections and an arcuate slot in said third section, said rod having its ends seatable in a selected pair of two pairs of recesses angularly related about said first axis and in the confronting surfaces of said first and fifth sections, and spring means engaging and urging said first and fifth sections apart, at points on the side of said first axis, opposite said recesses.

6. The ring of claim 4, said first means comprising (a) a cylinder sized for a smooth fit about the finger of a wearer, said sections encircling said cylinder with a smooth fit, (b) first and second pivot pin means aligned along a common diameter of said cylinder and first section and interconnecting the same to define said second axis.

7. The ring of claim 1, said first means comprising a cylinder sized for a smooth fit about the finger of a wearer, there being in addition to said first and second ring sections, third, fourth and fifth ring sections encircling said cylinder and sequentially disposed in the order mentioned, said third section being fixed with said cylinder between the ends thereof, said second and fourth sections being journaled on said cylinder, means interconnecting said second and fourth sections for rotation as a unit, said second section having a first arcuate spring seat channel in its inner periphery, abutment means fixed with said third section and having an end projecting into said first channel, said resilient means comprising a coil spring disposed in said first channel and compressed between one end thereof and said abutment means.

8. The ring of claim 7, there also being a second arcuate spring seat channel in the inner periphery of said fourth section, said abutment means also extending into said second channel, said resilient means also comprising a second coil spring in said second channel and compressed between one end thereof and said abutment means.

9. The ring of claim 7, the means interconnecting said second and fourth sections including a rod parallel with said first axis and passing with a smooth fit through aligned bores in said second and fourth sections and an arcuate slot in said third section, for axial translation relatively thereto.

10. The ring of claim 9, said first means connecting said first and fifth sections to said cylinder for limited pivoting about respective second and third mutually parallel axes normal to said first axis and defining a reference plane, said rod being on one side of said plane and having ends to seat in a selected pair of two pairs of recesses in the confronting faces of said first and fifth sections, respectively, and spring means on the other side of said reference plane, acting between said first and fifth sections and continuously urging said recesses toward the ends of said rod to thereby form said latch means, said first and fifth sections being tapered in thickness radially outward toward said spring means, to enable movement of said recesses away from the ends of said rod.

11. The ring of claim 1, said first means comprising a cylinder sized for a smooth fit about the finger of a wearer, there being in addition to said first and second ring sections, third, fourth and fifth ring sections encircling said cylinder and sequentialy disposed thereon in the order mentioned, said third section being fixed with said cylinder between the ends thereof, said second and fourth sections being journaled on said cylinder, a rod parallel with said first axis, passing through an arcuate slot in said third section and having its ends fixed in respective bores in said second and fourth sections, said latch means comprising a lever pivoted between its ends to said third section and having one end hooked to engage about said rod and maintain said second and fourth sections in said first position, the other end of said lever being manually actuable to move said hooked end free of said rod.

12. The ring of claim 11, said lever being disposed in a radial slot in said third section and communicating with said arcuate slot, and a spring in said radial slot contacting and urging said lever to move its hooked end into the path of said rod in and along said arcuate slot.

13. The ring of claim 12, there being axially-registering arcuate slots in and adjacent the inner peripheries of said first, third and fifth sections, a shaft passing through said slots and, with a smooth fit, through bores in said second and fourth sections, said shaft projecting at its ends from the arcuate slots in said first and fifth sections to enable manual arcuate adjustment of said second and fourth sections from said second to said first position.

14. The ring of claim 13, said first section having an arcuate spring seat channel in its inner face and communicating with the arcuate slot therein, and a coil spring disposed in said channel and compressed therein between one end thereof and said shaft.

15. The ring of claim 14, each said section being formed to define first and second outwardly-projecting points angularly spaced about said first axis through a small angle, said first and second points of all sections being disposed in a respective one of first and second planes through said first axis, when said sections are in said first position, the first and second points of said second and fourth sections being disposed in a respective one of third and fourth planes through said first axis, and angularly offset from said first and second planes, when said sections are in said second position.

* * * * *